US006679384B1

(12) United States Patent
Serres et al.

(10) Patent No.: US 6,679,384 B1
(45) Date of Patent: Jan. 20, 2004

(54) METHOD AND MEANS FOR PAPER PULP FILTERING

(75) Inventors: Alain Serres, Reims (FR); Alain Fernandez De Grado, Vitry le Francois (FR)

(73) Assignee: Kadant LaMort, Vitry le Francois (FR)

( * ) Notice: Subject to any disclaimer, the term of this patent is extended or adjusted under 35 U.S.C. 154(b) by 0 days.

(21) Appl. No.: 09/890,787

(22) PCT Filed: Feb. 25, 2000

(86) PCT No.: PCT/FR00/00468

§ 371 (c)(1),
(2), (4) Date: Aug. 6, 2001

(87) PCT Pub. No.: WO00/50690

PCT Pub. Date: Aug. 31, 2000

(30) Foreign Application Priority Data

Feb. 26, 1999 (FR) ..... 99 02425

(51) Int. Cl.[7] ..... B07B 1/04

(52) U.S. Cl. ..... 209/273; 209/306; 209/385; 210/413

(58) Field of Search ..... 209/273, 281, 209/283, 305, 306, 379, 385, 389; 210/413, 414, 415

(56) References Cited

U.S. PATENT DOCUMENTS 1,537,691 A 5/1925 Priem ..... 209/273
6,155,427 A * 12/2000 Pimley ..... 209/306 X

FOREIGN PATENT DOCUMENTS

| | | | |
|---|---|---|---|
| DE | 558 477 | 9/1932 | |
| DE | 3831845 A1 | 4/1990 | |
| EP | 0 398 685 | 11/1990 | |
| EP | O 473 354 A1 | 3/1992 | |
| FR | 2 613 390 | 10/1988 | |
| FR | 2 666 598 | 9/1990 | |
| GB | 2 222 967 A | 3/1930 | |
| SU | 1669585 | * 8/1991 | ..... 209/273 |
| WO | WO 97/41296 | 11/1997 | |

* cited by examiner

*Primary Examiner*—Tuan N. Nguyen
(74) *Attorney, Agent, or Firm*—Nixon & Vanderhye, P.C.; Frank P. Presta

(57) ABSTRACT

Process for the filtration of paper pulp with a device that comprises a rotor and a stator; one of the two, filter (1), has perforations of slot or hole types, and the other, the backwashing element, includes means that are intended to generate pressure pulses that consist in combatting the gradual clogging of the perforations of the filter and the gradual flocculation of the pulp during the creep of the pulp between the rotor and the stator by creating deflocculation zones and/or increasing the relative speed between the pulp and the backwashing elements.

17 Claims, 9 Drawing Sheets

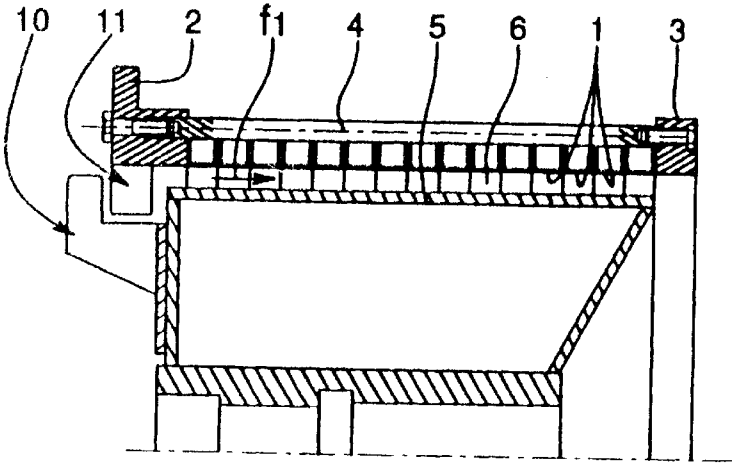
FIG. 1
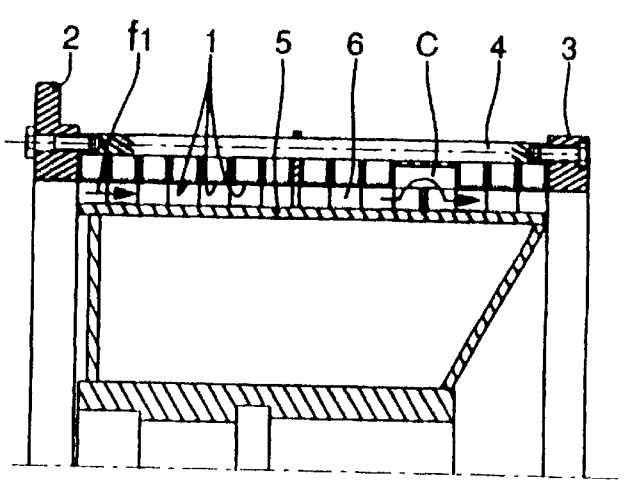
FIG. 4
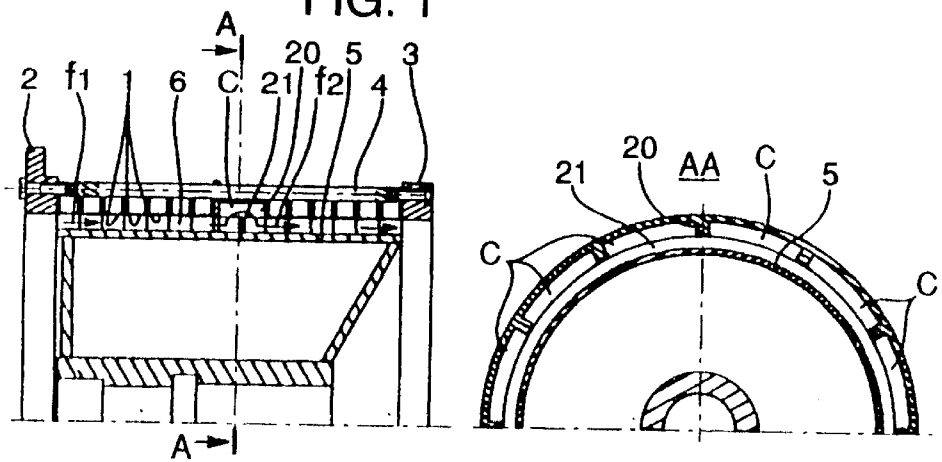
FIG. 2
FIG. 3
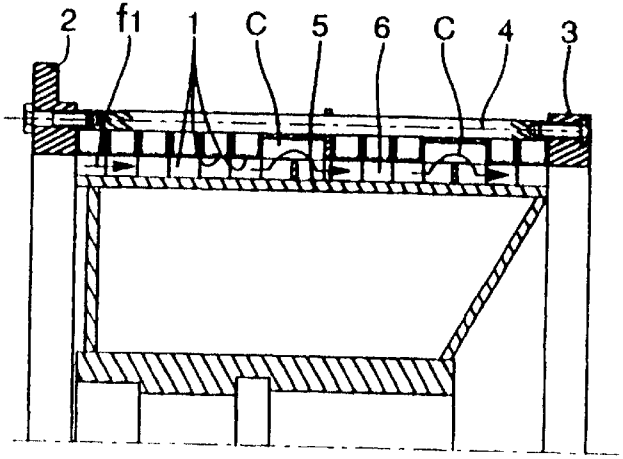
FIG. 5

METHOD AND MEANS FOR PAPER PULP FILTERING

This invention relates to the problems of filtration of paper pulp and more particularly paper pulp that is obtained from the pulping of old paper.

In paper pulp technology, it is known to use various filtration devices either to eliminate foreign elements or to classify paper pulp fibers according to their length or else to increase the paper pulp concentration by partial elimination of water.

Among the known filtration devices, filters are present that comprise a rotor and a stator, one of the two, called a screen below, performing die function of filtering and comprising perforations such as slots or holes, the other, called backwashing element below, performing the function of backwashing and comprising means intended to generate pressure pulses to prevent the clogging of the perforations. The screen can therefore be stationary or rotating, and, conversely, the backwashing element is rotating with a stationary screen aid stationary with a rotating sieve. In addition, the liquid can either flow through the sieve from the outside to the inside (toward the axis), so-called centripetal operation, or from the inside to the outside, so-called centrifugal operation.

In this type of device, the pulp reaches one end of the cylindrical screen, flows into the space between the cylindrical sieve and die backwashing filter, and comes out at the other end.

As the pulp advances into the filter, it becomes increasingly thick.

This gradual thickening of the pulp produces several effects: a pulp flocculation effect and a sieve clogging effect.

Even if the pulp that is admitted has previously been well deflocculated, there is the danger of flocks appearing during its advance; the greater the flocculation, the more significant the clogging.

If the backwashing filter rotates, it has a tendency to rotate the pulp with it. If the backwashing element is stationary, the screen has a tendency to rotate the pulp. In the two cases, as the backwashing effect by the pressure pulses that are caused by the backwashing element is directly linked to the speed deviation between the backwashing filter and the pulp, the more the pulp advances to the end of the screen, the less effective the backwashing is, while at the same time the screen is more prone to clogging.

In addition, with a fine-slot screen, the long fibers have more trouble passing than the short fibers, and therefore the proportion of long fibers relative to the short fibers increases with the advance of the pulp, which accelerates both the flocculation process and that of the clogging.

This accumulation of phenomena brings about a gradual reduction in production per unit of surface area of the screen as the pulp advances in the filter.

Many patents have had as their object to combat this gradual reduction of the productivity of the filter by intervening, during the travel along the screen, so as to create strong deflocculation zones and/or zones for greatly slowing the pulp.

In particular, from 1968 in her French Patent 1,539,816, the applicant proposed using obstacles whose purpose is to break the component parallel to the surface of the sieve from the speed of the liquid.

U.S. Pat. No. 4,383,918 proposed using obstacles that create turbulence between the screen and the rotor.

Patent FR 2,613,390, also in the name of the applicant, proposed separating the screen into several portions and introducing water for dilution between the portions of the sieve.

English Patent GB 2,222,967 proposed installing two sieves that are separated by stationary flanges placed between the surface of the screen and the rotor.

All of these devices have gradually improved the operation of filtration devices that consist of a sieve and a backwashing filter bait in a way that is still inadequate.

According to this invention:

The zone where the speed deviation increases can be one or more baffles;

The zones for deflocculation and increasing the speed deviation can be combined.

This invention relates to a filtration device or purifier of the type that comprises a screen of cylindrical shape and a coaxial rotor that is equipped with blades that produce pressure fluctuations to prevent the clogging of said screen; whereby said screen and said rotor comprise at least two portions of approximately equivalent diameter, whereby these portions are separated from one another by means whose object is to break the component from the speed of the liquid, which is parallel to the surface of the screen, and to create turbulence characterized by the fact that said means are baffles that consist of, on the one hand, cavities that are placed between the portions of the screen, whereby the bottom of said cavities is optionally farther from the rotor than the surface of the screen; and, on the other hand, annular deflectors that are carried by the rotor opposite each cavity; such that it is necessary for the majority of the liquid flow to pass through the cavities.

This invention can also comprise all or part of the following arrangements, taken together or separately:

a The screen consists of a stack of rings, b The screen consists of a grid that is obtained by juxtaposing bars that are either parallel to the axis of rotation of the rotor or perpendicular or inclined, c The screen consists of a juxtaposition of grids as described in the preceding paragraph, whereby these grids are separated by rings, d The screen consists of a cylindrical sheet-metal plate that is perforated with holes or slots, e The screen consists of a stack of cylindrical pieces of sheet metal that are perforated with holes or slots, f The cavities are parallelepipedic hollow volumes, g The cavities are cylindrical hollow volumes, h Some cavities can be connected at the bottom to a dilution intake which can be ensured by water or pulp that is less concentrated than the filtered pulp.

The purpose of this invention is also the use of this device with regulating means that make it possible:

a) either to adjust the rotor speed based on the pressure differential of the pulp between the inlet of the device and at least one of the accepted outlets;

b) or to adjust the rotor speed based on the flow rate or rates in at least one of the outlets for accepted products;

c) or to adjust the flow rate of the output for rejects from the device based on the accepted flow rates and dilution flow rates that are measured to regulate the rate of rejects from one or more portions of the screen;

d) or by combining two or three of these regulating means.

The purpose of this invention is also the use of means that are described above for the filtration of the paper pulp.

By way of nonlimiting examples and to facilitate the understanding of the invention, the accompanying drawings are shown;

FIG. 1: A first embodiment that comprises a slowing zone obtained with baffles.

FIG. 2: A cutaway view along AA of FIG. 1.

FIG. 3: A variant embodiment of FIG. 1.

FIG. 4: A second variant embodiment of FIG. 1.

FIG. 5: A second embodiment according to the invention that combines a deflocculation zone according to FIG. 1 and a slowing one according to FIG. 1.

FIG. 6. A third embodiment that uses the slowing means of FIG. 1, in a centripetal filter.

FIG. 7: A perspective view that illustrates a screen according to the invention.

FIG. 8: A perspective view that illustrates the rotor that is intended to be placed in the interior of the screen of FIG. 7.

FIG. 9: A partial perspective view that shows the interior of the screen of FIG. 7.

FIGS. 10 and 11: Two partial and large-scale views of FIG. 9.

FIG. 12: A partial view of the interior of a variant embodiment of the screen of FIGS. 7, 9, 10 and 11.

FIG. 13: A partial view of a variant embodiment of a filtering element according to the invention.

FIG. 14: A partial view of another variant embodiment of a filtering element screen according to the invention.

FIG. 15: A vertical cutaway view of a filtering element according to the invention.

FIG. 16: An embodiment of a filtration device.

FIG. 17: A embodiment of a filtration device.

In all of FIGS. 1 to 6, the screen consists of, as was described in Patent EP 0 707 109, a stack of circles 1 with a U-shaped section, pressed against one another by means of two end rings 2 and 3 that are assembled together by tie rods 4 that make it possible to ensure prestressing. The bases of the U are equipped with perforations (whether slots or holes).

The pulp arrives in the filter by its end that is located at the left of the figure (on the side of ring 2) and comes out via its opposite end (on the side of ring 3) by circulating in space 6 that is located between backwashing element 5 and the screen as indicated by arrow f1.

It should be noted, however, that the invention is not limited to this particular screen structure but can be applied to any cylindrical screen as will be described below.

According to the invention, a zone for slowing the speed at which the pulp is entrained is created.

For this purpose, as is illustrated in FIGS. 1 and 2, a series of baffles that slow down the rotating movement of the pulp are used in the screen.

By referring to these figures, it is seen that one or more circles 1 are replaced by a number of partitions 20, parallel to the axis of the filter that with the flanges of two rings 1 that frame it constitute a number of parallelepipedic cavities C that are placed over the entire circumference of the screen.

Opposite these partitions 20 is placed an annular partition 21 that is perpendicular to the axis of the filter and carried by rotor 5.

Thus, as is shown by arrow f2, the pulp flow is deflected by annular partition 21 and comes up against partitions 20 that are linked to the screen and passes through cavities C to return into space 6.

This causes a slowing of the rotation speed of the pulp, and, at the same time, a stirring of the pulp that has a deflocculation effect and a fluidization effect.

Fluidization is defined as a stirred state and a state without flock of the pulp that promotes the flow into the openings, holes or slots of the sieve.

The result is that the screen is divided into two portions:

a first portion upstream from ring of cavities C and a second portion downstream, whereby these two portions are separated from one another by ring of cavities C.

The result is also that the rotor is divided into two portions by circular partition 21.

In FIG. 1 placed in the center of the screen; in FIG. 3, it is placed close to the end, i.e., where the clogging effects are the most significant because of the thickening of the pulp.

FIG. 4 combines the arrangements of FIGS. 1 and 3.

According to the example that is illustrated in FIG. 5, turbulence is created in addition by flanges 10 that are fixed to the backwashing element and flanges 11 that are fixed to the screen.

These flanges 10 and 11 can be radial or inclined and can have inclinations in the opposite direction.

Preferably, as is shown in FIG. 5 the shapes of flanges 10/11 arc such that they overlap one another.

In the zone where said flanges are found, a violent stirring is thus obtained that carries out a good deflocculation of the pulp.

FIG. 6 shows a centripetal filter that uses the means of FIG. 1. The same elements bear the same references.

In this figure, screen 1 is found inside of backwashing element 5. The pulp arrives via the end of the screen and circulates in space 6 that is located between screen 1 and backwashing element 5.

In a zone of screen 1, the circles with U-shaped section are replaced by partitions 20, parallel to the axis of the cylinder, and backwashing element 5 comprises an annular partition 21.

As in the case of FIG. 1, the pulp is deflected by annular partition 21 and comes up against partitions 20.

FIGS. 7 to 17 show a variant embodiment of the device that uses the process according to this invention.

FIG. 7 shows a cylindrical screen 30 that consists of bars 31 that are placed vertically beside one another with a slight play (between 0.05 mm and 1 mm) and fixed to horizontal rings 32, 33, 34, 35, 36 and 37.

These rings 32 to 37 are traversed by tie rods 38 and are parallel to the axis o the cylinder, whereby these tie rods 38 are fixed to two end rings 32 and 37, such that the unit is held in place by the clamping of tie rods 38.

FIG. 8 shows rotor 40 which is placed in the interior of the screen of FIG. 7. This rotor a cylinder that comprises three annular rings 41, 42 and 43. In the zones included between the annular rings are placed blades 45, usually called "foils" in the paper pulp industry.

The function of foils 45 is to create pressure/partial vacuum pulses that tend to prevent the clogging of the screen.

Rings 41 to 43 are placed on the rotor to be opposite rings 33, 34 and 35.

It will be explained below how rings 33, 34 and 35 of sieve 30 work with rings 41, 42 and 43 of the rotor to form baffles.

As seen in FIG. 8, annular rings 41, 42 and 43 define four zones of rotor 40.

The shape, the number and the inclination of the blades or foils 45 can vary from one zone to the next.

FIG. 9 shows the screen of FIG. 7, seen from the interior.

It is seen that rings 33, 34 and 35 are hollow so as to define cavities C.

In this example, as sieve 30 is made of juxtaposed bars 31, cavities C are not made as in the case of FIGS. 1 to 6 where the screen consisted of U's.

As is seen in FIG. 9, rings 33, 34 and 35 consist of a ring that comprises a multitude of parallelepipedic cavities that have virtually the same shape as cavities C of FIGS. 1 to 6.

Some cavities C of rings 33 and/or 34 also comprise orifices that are connected to pipes 50 for dilution intake.

Figure 6:
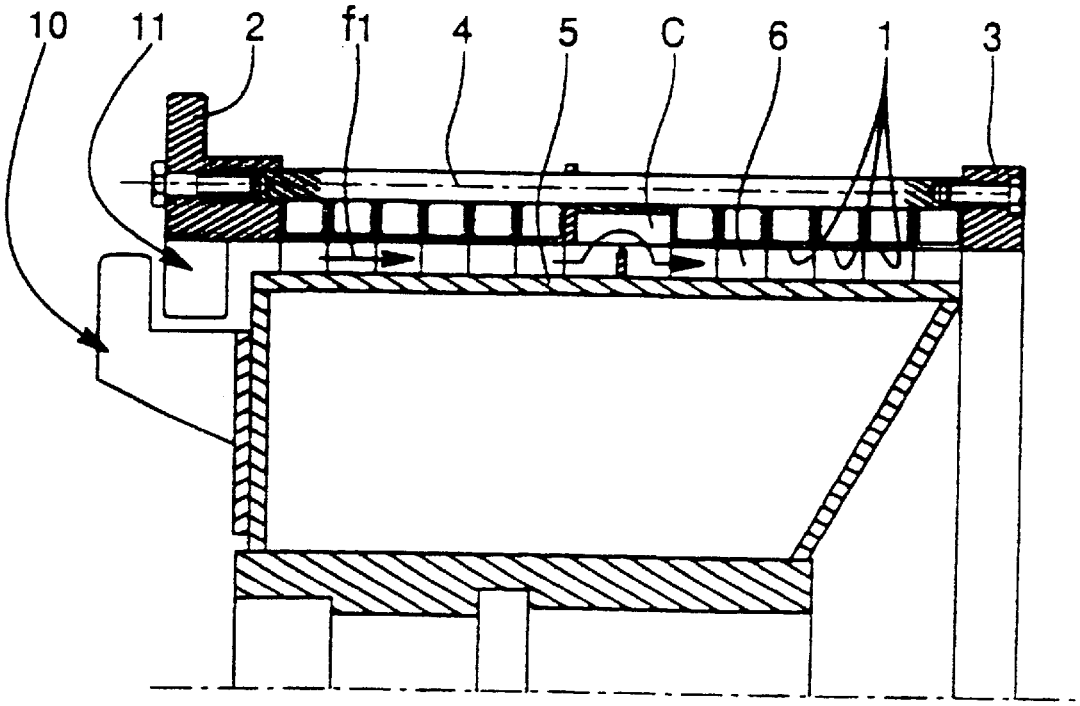
Figure 7:
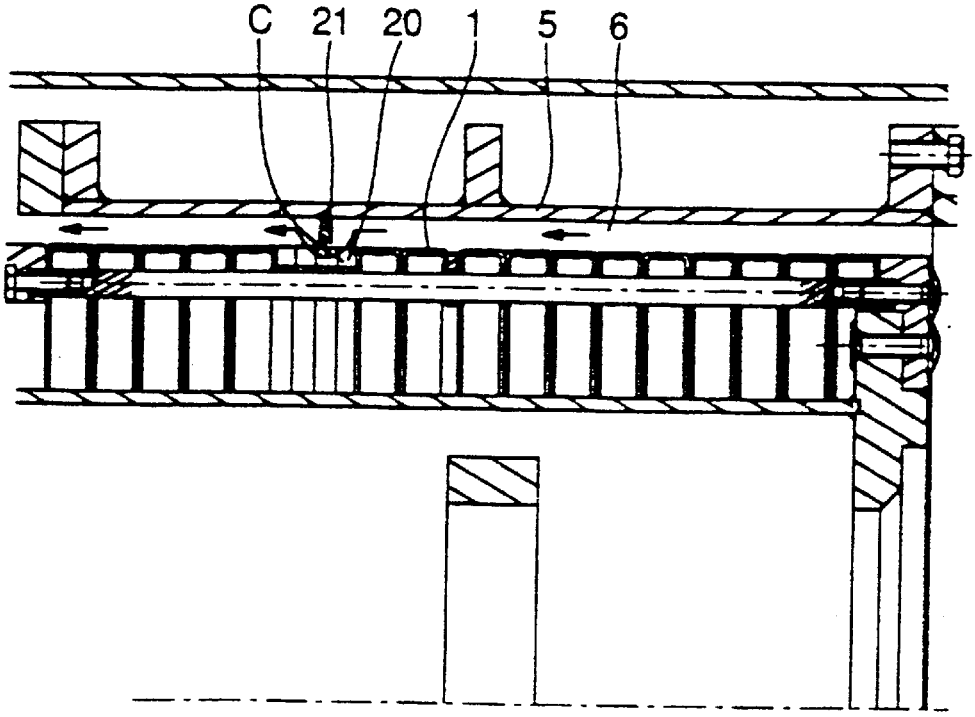
Figure 8:
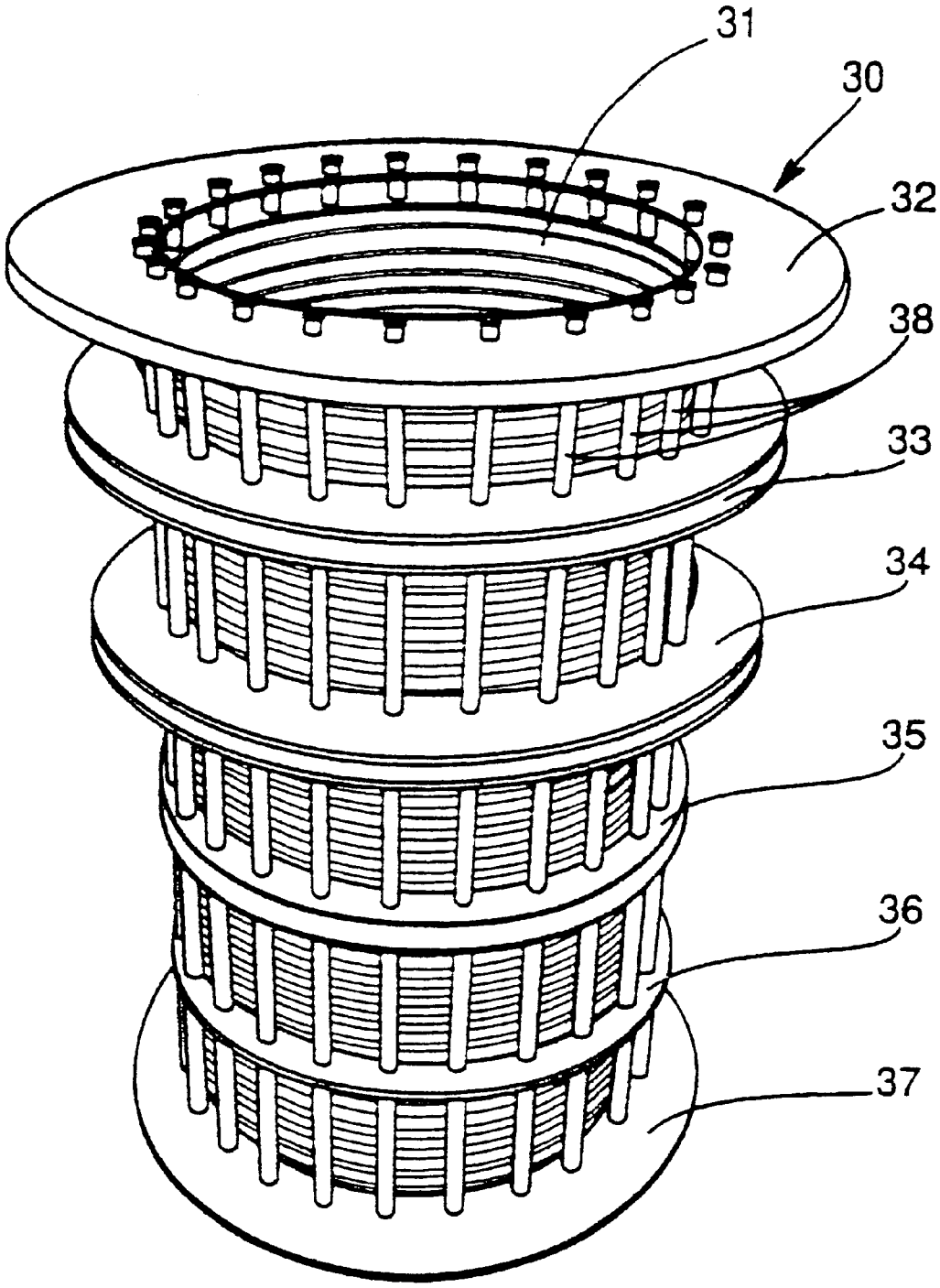
Figure 9:
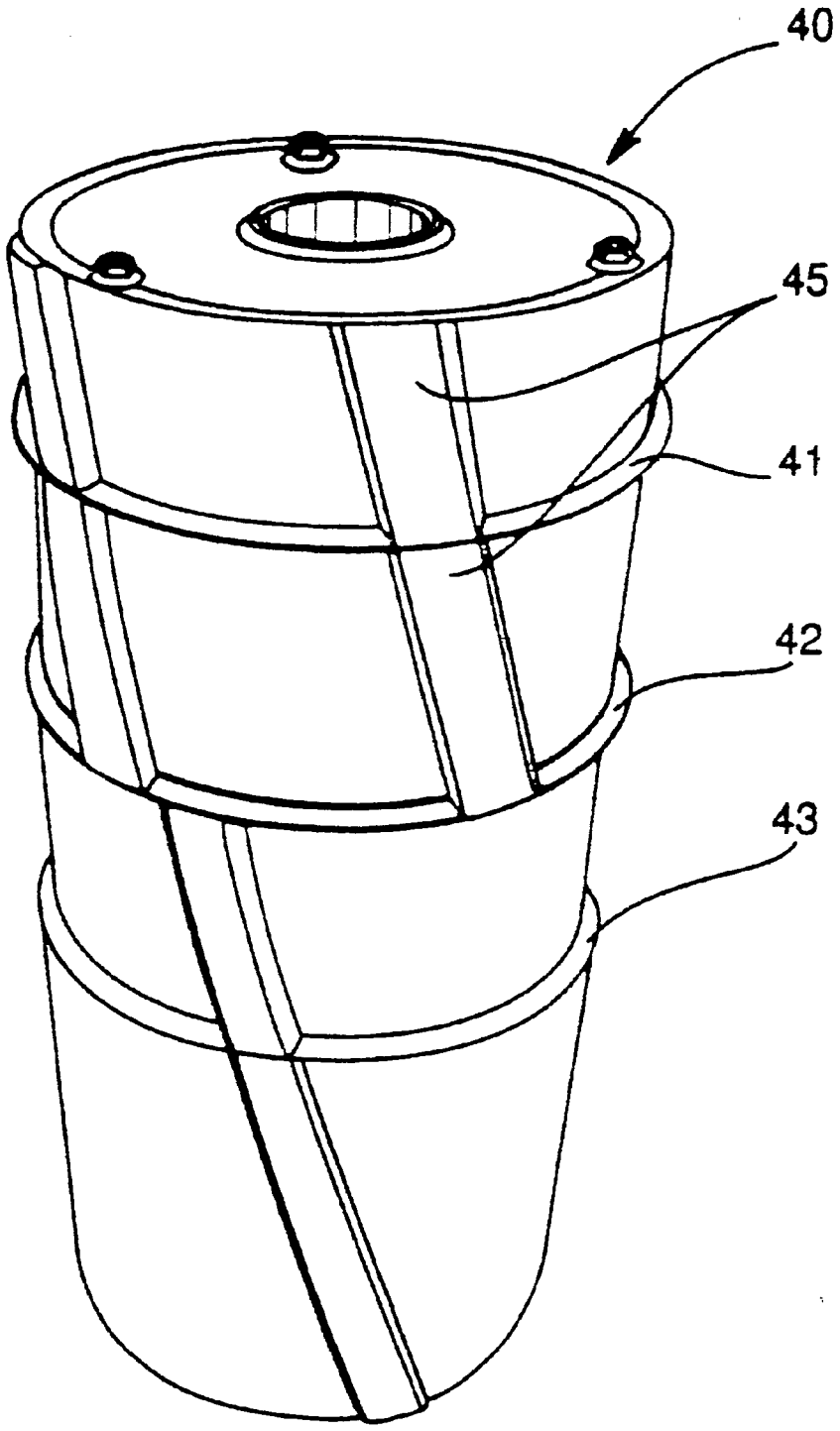
Figure 10:
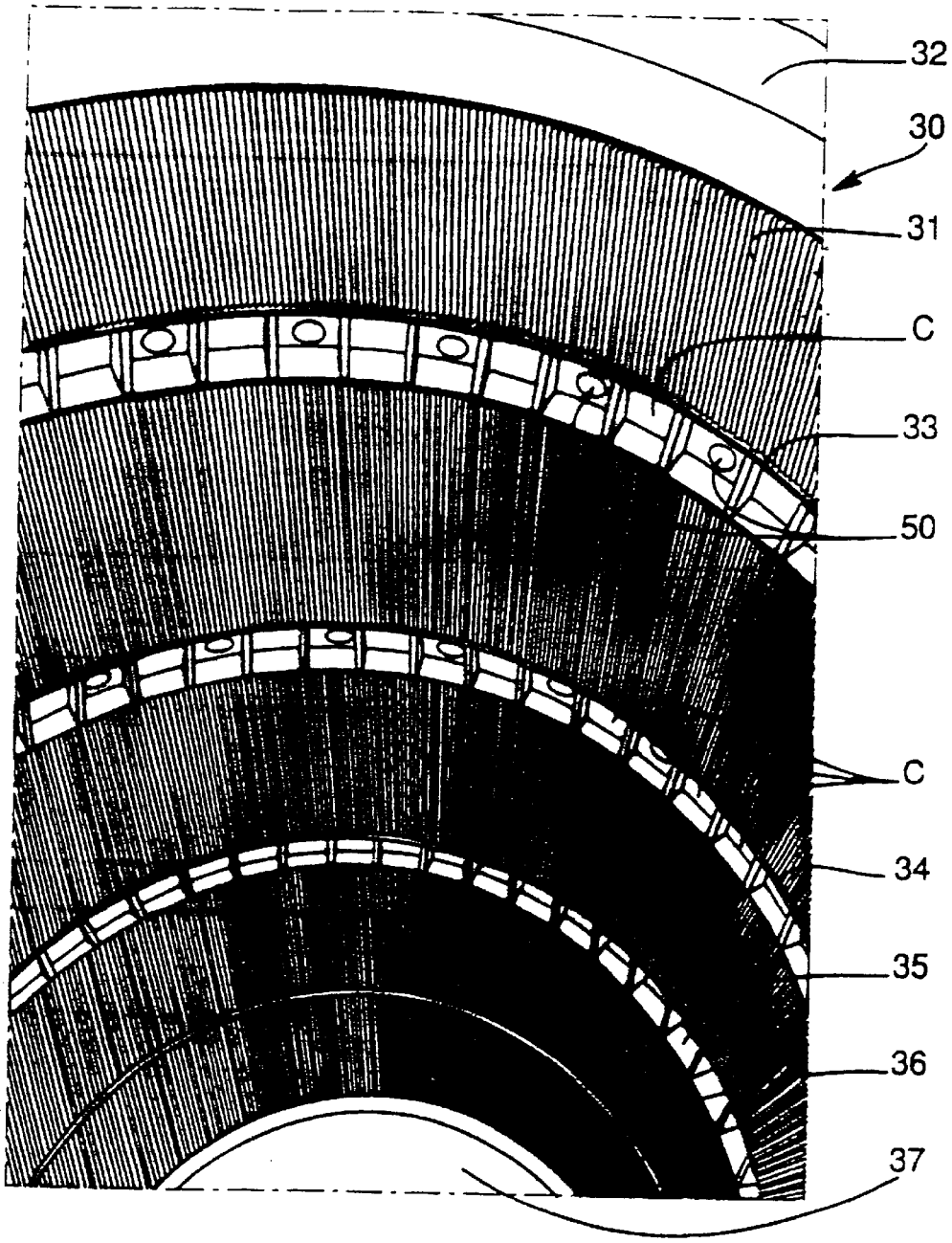
FIGS. 10 and 11 are detail views in larger scale of FIG. 9.
Figure 11:
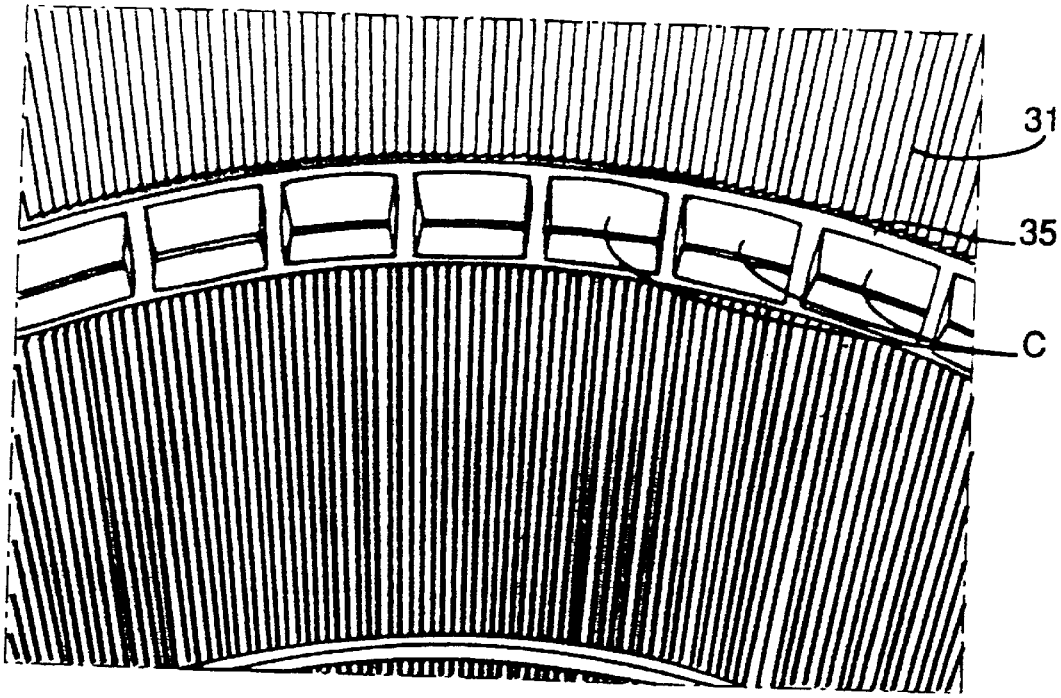
Figure 12:
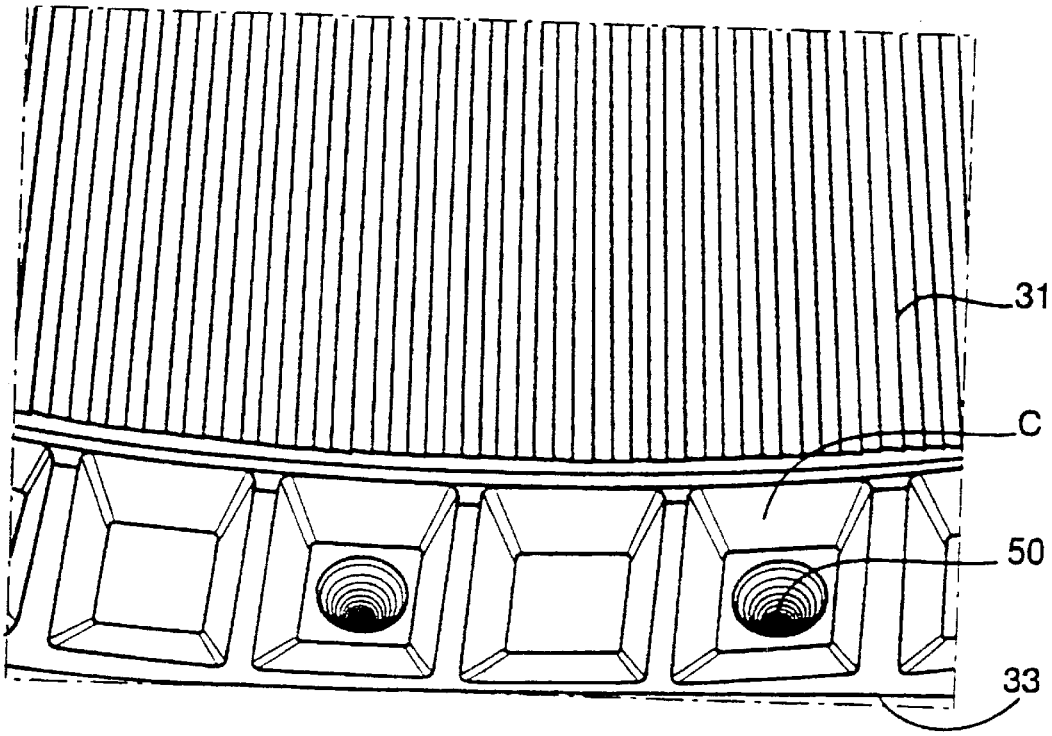
FIG. 12 illustrates a variant according to which, instead of using parallelepipedic cavities C, cylindrical cavities or recessed holes D, whereby some can be connected to pipes 50, are used.
Figure 13:
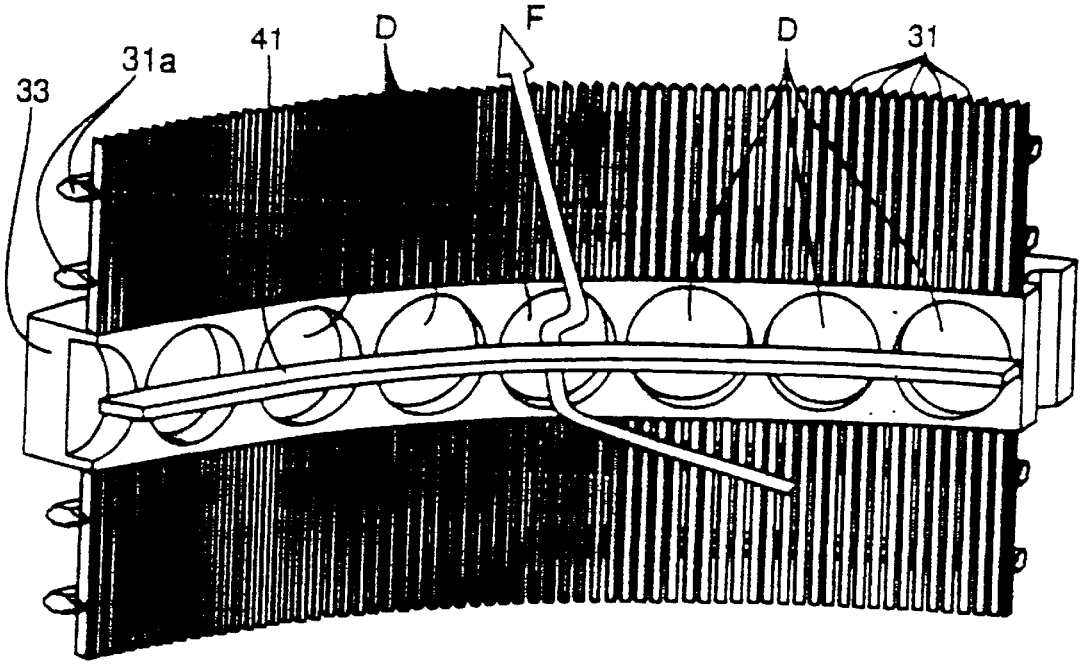

As is illustrated in FIG. 12 (recessed holes D) and in FIG. 13 (parallelepipedic cavities C), the annular ring of rotor 41 (42, 43) that works with ring 33 (34, 35) is placed so as to be virtually at the center of cavities C or cylindrical holes D.

Arrow F illustrates how the pulp that comes from the zone that is located below rings 33, 41 is forced to enter into a cavity C or D, whereby this cavity and ring 41 form a baffle that considerably slows the speed of the pulp.

It is seen in these figures that bars 31 are held in place by hoops 31*a*.

Figure 14:
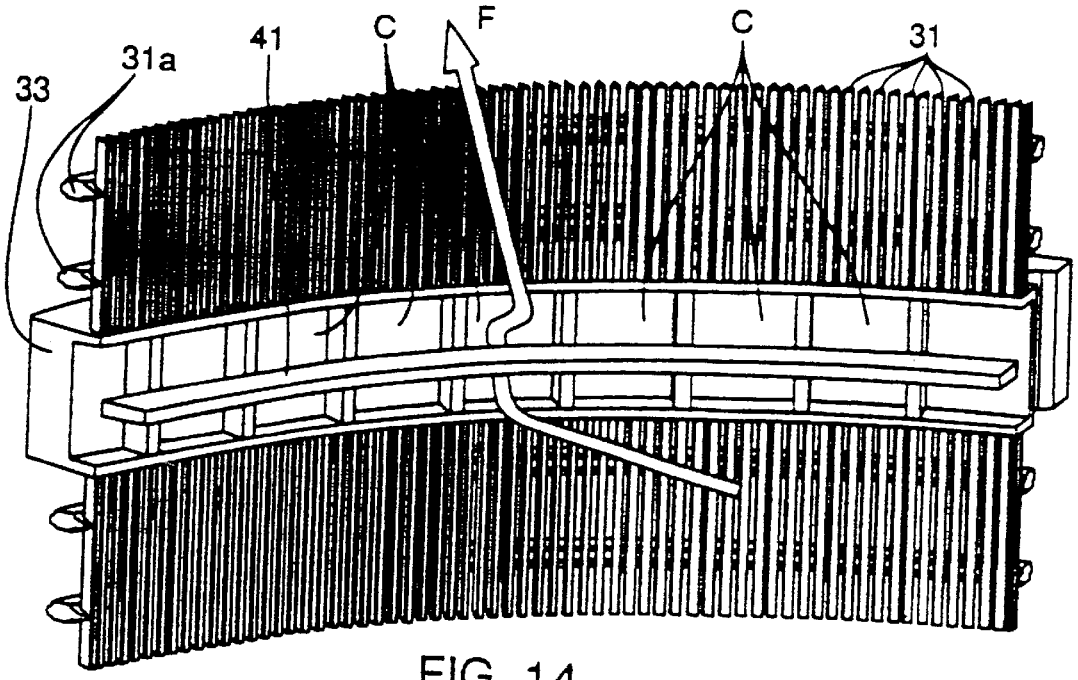

FIG. 14 illustrates another variant embodiment in which the same elements bear the same references.

In this example, sieve 30 is stationary and placed outside of rotor 40 that carries foils 45. Ring 41 of rotor 40 is opposite ring 33 of sieve 30 so that cavities C of said ring 33 form a series of baffles with annular ring 41.

In this figure, a pipe 50, which is a water pipe, empties into the bottom of cavity C.

This makes it possible to combine the slowing action that is caused by baffles C with a dilution action of the pulp, which has a tendency to thicken as it passes through the filtration device.

Figure 16:
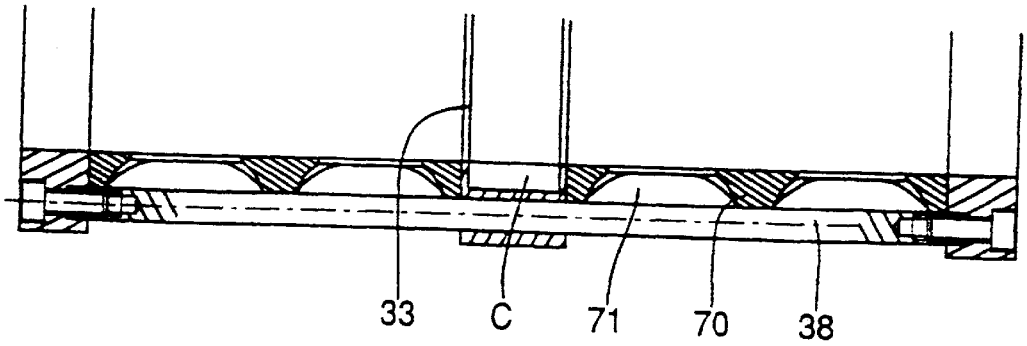
Figure 17:
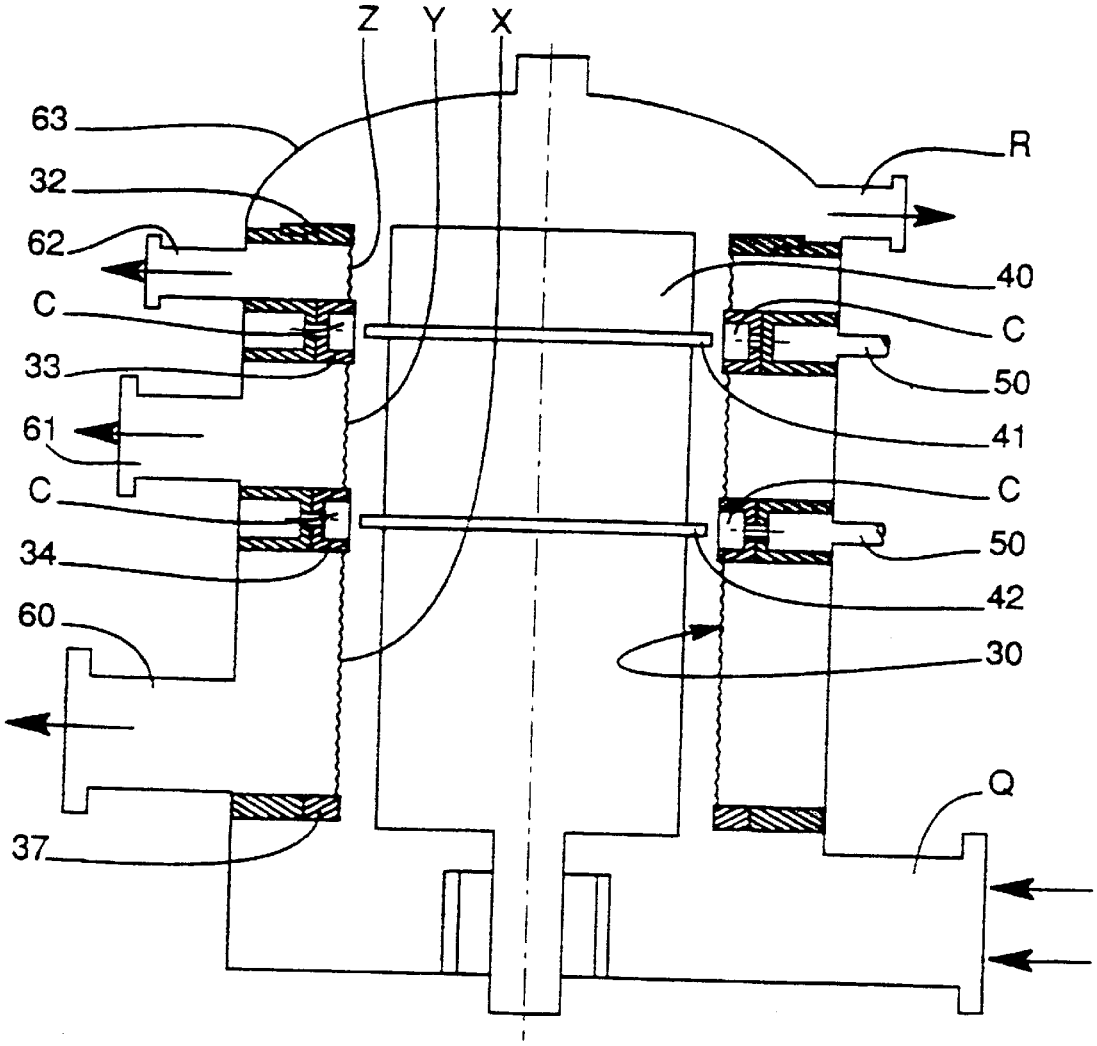

By referring to FIG. 16, it is seen that the filtration element according to the invention may comprise, from top to bottom:

An upper end ring 32 for screen 30,

An intermediate ring 33 that comprises a number of cavities C, some of which are connected to dilution pipes 50, A second intermediate ring 34, analogous to ring 33, A lower end ring 37, connected to ring 32 by tie rods, not shown, An annular ring 41, carried by the rotor, and located opposite cavities C of ring 33 to define with it a number of baffles, A second annular ring 42, carried by the rotor, located opposite cavities C of ring 34.

The filtration element that consists of screen 30 and rotor 40 is thus divided into three zones X, Y and Z and starts from the bottom.

The pulp that is to be purified arrives at Q at the base of the device.

Zone X comprises an outlet 60 for so-called "accepted" products, i.e., that have passed through screen 30; zone Y comprises an outlet 61 for accepted products, and zone Z comprises an outlet 62 for accepted products.

It is quite obvious that the pulp will have a tendency to thicken and to flocculate as it passes from one tone to the next.

As was said, the thickening causes a reduction in backwashing efficiency that should be compensated for by, for example, a higher speed and therefore a larger energy consumption. The introduction of water into pipes 50 that empty into certain cavities C or D of ring 34 and ring 33 makes it possible to combat this thickening and thus makes it possible to reduce the speed of the rotor and therefore to save energy.

In its upper portion, the device comprises a cover 63, an outlet R for waste.

It is possible to adjust the speed of rotor 40 based on the pressure differential between inlet Q in the device and at least one of the pressures that prevail in outlet pipes for accepted products 60, 61, 62.

It is also possible to adjust the speed of rotor 40 based on one or more of the flow rates in ducts 60, 61 or 62.

In one or the other case, this makes it possible to reduce the speed of rotation of rotor 40 and therefore to reduce the amount of energy needed.

Figure 15:
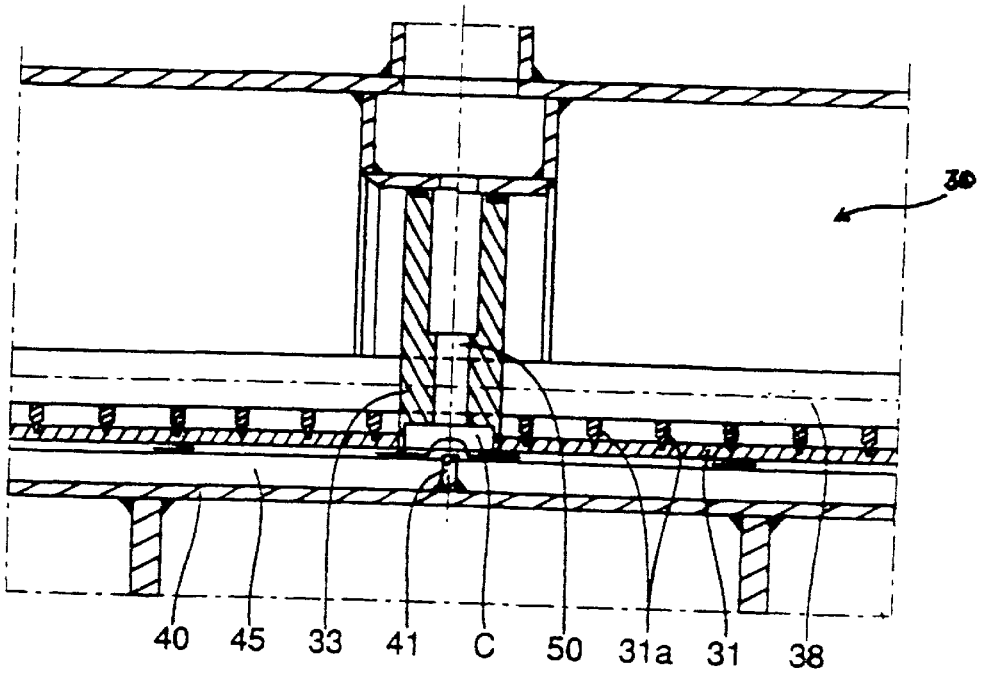

The screen can be produced in multiple ways, either by stacking U-section rings of FIGS. 1–6, or by stacking grids that are obtained by juxtaposing bars of FIGS. 12 and 13, or by stacking cylindrical pieces of sheet metal that are perforated with holes or slots of FIG. 15.

Thus, for example, they can consist of plates 70, in the material from which grooves 71 were cut with circular cutters, whereby the slots are then machined with circular saws.

It should be noted that by using backwashing blades 45 in an inclined way, a sort of pumping that accelerates the circulation in the device is obtained.

It should also be noted that whereby rotor 40 is divided into as many portions as sieve 30 has, it is possible with each portion of the rotor to use blades 45 that are different as to their number, their shape and their inclination.

In the same way, the different portions of the sieve can have different constitutions.

In all of the examples that are shown, the edges of cavities C or D are exactly at the same level as the one of the inside wall of screen 30.

It is possible to use them so that they project slightly into the interior of screen 30, provided that this does not prevent the introduction of rotor 40 into screen 30, i.e., that the annular rings such as 41, 42, etc., can pass.

What is claimed is:

1. Filtration device of the type that comprises a cylindrical-shaped screen (30) and a backwashing element (40) that is equipped with blades (45) that produce pressure fluctuations to combat the clogging of said screen, whereby said screen is composed of at least two portions of approximately equivalent diameter that are separated from one another by means whose purpose is to break the component from the speed of the liquid, which is parallel to the surface of the screen, and to create turbulence, characterized by the fact that said means are baffles that comprise, on the one hand, cavities (C, D) that are provided in an annular ring (33, 34, 35) of the screen that is placed between said portions of the screen, and, on the other hand, an annular deflector (21, 41, 42, 43) that is carried by the backwashing element opposite each ring of the screen that carries the cavities, such that it is necessary for the majority of the liquid flow to pass through the cavities.

2. Filtration device according to claim 1, wherein screen (30) comprises a stack of rings.

3. Filtration device according to claim 1, wherein screen (30) comprises a stack of grids, whereby each grid is obtained by juxtaposing bars (31) that are either approximately parallel to the axis of rotation of rotor (40) or perpendicular to this axis, or inclined.

4. Filtration device according to claim 1, wherein screen (30) comprises a stack of cylindrical pieces of sheet metal with holes or slots.

5. Filtration device according to claim 1, wherein the different portions of screen (30) are constituted in differing ways.

6. Filtration device according to claim 1, wherein the cavities are parallelepipedic (C).

7. Filtration device according to claim 6, wherein some cavities are connected to a dilution pipe (50).

8. Filtration device according to claim 1, wherein the cavities are cylindrical hollow volumes (D).

9. Filtration device according to claim 1, wherein the number, the type, the thickness and the inclination of blades (45) carried by backwashing element (40) can vary between annular deflectors (41, 42 . . . ).

10. Filtration device according to claim 1, wherein it also comprises a zone for violent stirring placed at the inlet of the screen.

11. Filtration device according to claim 6, wherein the turbulence in the violent stirring zone placed at the inlet of the screen is created by flanges (10) fixed to the backwashing element and flanges (11) fixed to the screen.

12. Process for use of a filtration device according to claim 1 for the treatment of paper pulp.

13. Process for use of a filtration device according to claim 12, comprising: providing each portion (X, Y, Z) of the filtration device with an outlet for accepted products (60, 61, 62); providing each annular ring (33, 34) of screen (30) with a dilution intake, providing the filtration device with an inlet Q, a waste outlet R, and manipulating the adjustments of the outlets for accepted products, of the outlet for waste and dilution intakes via ducts (50), to reduce the rotation speed of rotor (40) so that it is the lowest possible so as to save energy, while maintaining a low flow rate of the waste.

14. Process for use of a filtration device according to claim 13, according to which the speed of backwashing element (40) is adjusted based on the pressure differential between inlet (Q) in the device and at least one of the pressures that prevail in outlet pipes (60, 61, 62) for accepted products.

15. Process for use of a filtration device according to claim 13 according to which the speed of backwashing element (40) is adjusted based on at least one of the flow rates in outlet pipes (60, 61, 62) for accepted products.

16. Process for use of a filtration device according to claim 13, according to which the rate of rejects of one or more portions of the screen is adjusted by adjusting the outlet flow rate of the rejects of waste outlet R by taking into account accepted flow rates and dilution flow rates.

17. Process for use of a filtration device according to claim 14.

* * * * *